United States Patent [19]

Hirata et al.

[11] 4,205,567

[45] Jun. 3, 1980

[54] APPARATUS FOR SAFETY OPERATING PRESSES AND THE LIKE

[75] Inventors: Tadashi Hirata, Yamato; Nobuyuki Ikeda, Hadano, both of Japan

[73] Assignee: Amada Company Limited, Isehara, Japan

[21] Appl. No.: 963,738

[22] Filed: Nov. 27, 1978

[30] Foreign Application Priority Data

Nov. 28, 1977 [JP] Japan ..... 52-141540

[51] Int. Cl.[2] ..... B26D 7/24

[52] U.S. Cl. ..... 83/62; 83/63; 83/61; 83/62.1

[58] Field of Search ..... 83/62, 63, 62.1, 64, 83/58, 61

[56] References Cited

U.S. PATENT DOCUMENTS 3,407,913 10/1968 Tezuka ..... 83/58

3,728,919 4/1973 Scott ..... 83/62

4,006,655 2/1977 Maurer ..... 83/63

FOREIGN PATENT DOCUMENTS 47-20679 4/1970 Japan ..... 83/63

*Primary Examiner*—Donald R. Schran

*Attorney, Agent, or Firm*—Wigman & Cohen

[57] ABSTRACT

The present invention relates to an apparatus for detecting mis-strippings in a press having a ram and upper and lower tools for punching workpieces. The apparatus comprises an electric circuit which is closed when the ram and the upper tool are in contact with each other. A relay is provided in the electric circuit and is actuated when the ram and the upper tool are brought out of contact with each other when the ram is returning from a bottom dead-center position to a top dead-center position. Also, a contact in the relay is connected with a main circuit for driving the press.

4 Claims, 7 Drawing Figures

APPARATUS FOR SAFETY OPERATING PRESSES AND THE LIKE

BACKGROUND OF THE INVENTION

1. Field of the Invention

The present invention relates generally to presses and the like having a ram and upper and lower tools for processing workpieces such as sheet metals and more particularly to a method and apparatus for which are applicable to presses in case that the upper tool is mounted free from the ram.

2. Description of the Prior Art

As is well known, presses are provided with a vertically movable ram and upper and lower tools or dies which are worked by the ram to process workpieces such as sheet metals. In such presses, the upper and lower tools are held or mounted generally in two manners so as to cooperate with each other. In one of the manners, the upper tool is secured to the lower end of the ram, while the lower tool is mounted on a work-table or bolster just beneath the ram. In the other manner, both of the upper and lower tools are mounted free from the ram, and both the tools are unitized as a tool assembly or die set to be mounted on the work-table just beneath the ram. Also, in the latter manner, the upper and lower tools are held free from the ram on a tool holding means such as a pair of turret members which are so designed as to hold a number of upper and lower tools and selectively bring a desired pair of upper and lower tools into position just under the ram. Nowadays, the upper and lower tools are mostly employed as a tool assembly or die set for the convenience of installation and for other reasons, and also they are in many cases held on turret members in automatic presses which are numerically controlled.

In the manner in which the upper tool is mounted free from the ram, the upper tool is so arranged as to be drawn up or stripped by a stripping spring out of a workpiece to be processed after each completion of a processing cycle. More particularly, such a stripping spring is so disposed as to be compressed when the ram is urging the upper tool to the workpiece and the lower tool and then lift up or strip the upper tool out of contact with the workpiece.

Especially in punching and blanking operations, however, the upper tool will often fail to be stripped out of the workpiece after a completion of a processing cycle from various causes such as breakage or fatigue of the stripping spring and wear or thermal expansion of the upper tool. Of course, when the upper tool is mis-stripped or not stripped out of the workpiece in punching and blanking operations, it often happens that the upper tool will be caught not only in the workpiece but also in the lower tool. Anyway, it is very dangerous that the upper tool is mis-stripped or fails to be stripped from the workpiece, since the press will go on moving with the upper tool caught in the workpiece. Also, any or all of the upper and lower tools, the workpiece and the press will be damaged or broken if the workpiece is forcedly moved by power when the upper tool is caught in the workpiece because of mis-stripping. Since workpieces are mostly moved or fed into presses automatically by power especially in punching and blanking operations, damage to tools, workpieces and presses has heretofore frequently occurred. Thus, it is absolutely necessary to stop the workpiece from being moved and also the press from being driven the moment the upper tool is caught in the workpiece because of mis-stripping especially when the workpiece is being automatically fed by power. Of course, it is necessary first to detect mis-stripping of the upper tool to stop the workpiece and the press from being moved the moment the upper tool is mis-stripped.

Heretofore, various attempts have been made to detect mis-stripping of upper tools in presses in order to stop workpieces and presses from being moved or driven the moment mis-strippings occur. For example, a photoelectric tube is employed so that it may check each return of the upper tool to its normal position after each completion of a processing cycle so as to stop the workpiece and the press when the upper tool is not normally returned to its position. As another example, a drive source such as an electric motor for automatically feeding the workpiece into the press is so arranged as to be stopped when it is overloaded because of mis-stripping of the upper tools.

However, all of the conventional measures have suffered from serious shortcomings, and it has been impossible to securely detect mis-strippings of upper tools to stop workpieces and presses from moving the moment mis-strippings occur. The manner using the photoelectric tube is not applicable in high-speed punching and blanking operations in which a millisecond matters, since the upper tool takes time to return to its normal position and there will be a time lag between occurrence and detection of mis-stripping of the upper tool. Also, it is difficult to mount the photoelectric tube in tool holding means such as turret members where a number of tools are thickly mounted. In the manner to detect mis-stripping from an overload of the drive source for feeding the workpiece, it takes time to detect the overload of the drive source after the occurrance of mis-stripping, and therefore the workpiece and the press could not be stopped the moment mis-strippings occur in high-speed punching and blanking operations. Furthermore, the drive source will not be overloaded to the extent to be detected when a thin workpiece is being processed even if a mis-stripping of the upper tool occurs.

SUMMARY OF THE INVENTION

It is an object of the present invention to provide a method for detecting mis-strippings of the upper tool out of workpieces to be processed in presses to stop the workpieces and the presses for safety reasons the moment the mis-strippings occur.

It is another object of the present invention to provide an apparatus for safely operating presses in which mis-strippings of the upper tool out of workpieces to be processed can be securely detected in the presses in order to stop the workpieces and the presses the moment the mis-strippings occur.

Accordingly, it is another object of the present invention to provide a method and apparatus which are applicable to high-speed working presses to detect mis-strippings of the tools so as to stop the workpieces and the presses the moment the mis-strippings occurs.

It is a further object of the present invention to provide a method and apparatus which are reliable and low-cost to detect mis-strippings of the tools in the presses to stop the workpieces and the presses the moment the mis-strippings occur.

Other and further objects and advantages of the present invention will be apparent from the following description and accompanying drawings which, by way of illustration, show preferred embodiments of the present invention.

DESCRIPTION OF THE PREFERRED EMBODIMENTS

Figure 1:
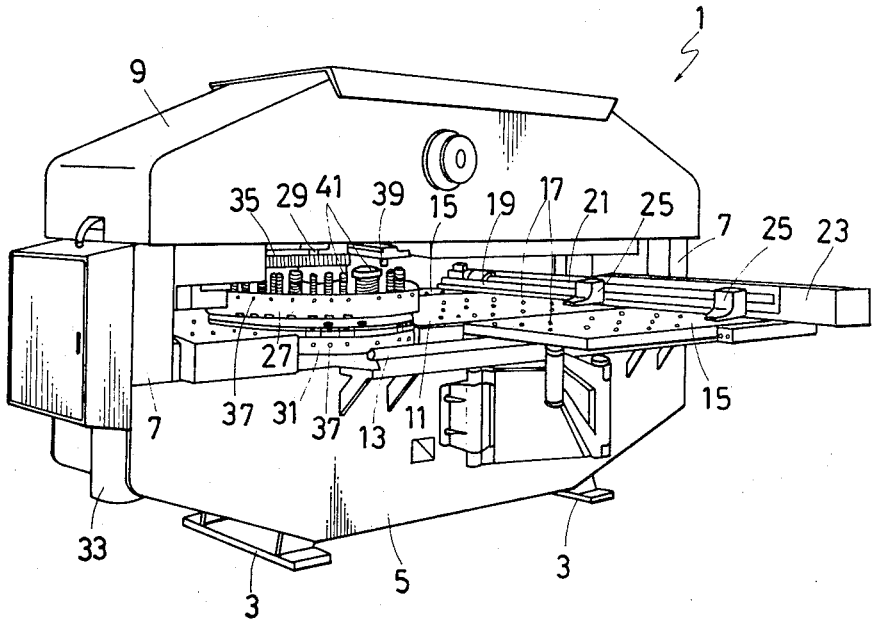
FIG. 1 is a perspective view illustrating a turret punch press embodying the principles of the present invention.

Referring to FIG. 1, there is shown a turret punch press 1 in which the principles of the present invention can be embodied. The turret punch press 1 is constructed of a lower frame 5 supported by legs 3 and an upper frame 9 which is supported by the lower frame 5 by a plurality of corner posts 7. There is provided at one side of the lower frame 5 a fixed table 11 on which a workpiece (not shown) to be processed is to be placed. A pair of Y-axis guide-bars 13 are provided on both (front and rear) sides of the fixed table 11 to horizontally extend along the Y axis, and a pair of movable tables 15 for supporting the workpiece together with the fixed table 11 are slidably mounted on the Y-axis guide-bars so as to move in the Y axis. The fixed table 11 and the movable tables 15 are provided on their top surface with a plurality of free bearings 17 so as to enable the workpiece to be freely moved thereon. The front and rear movable tables are integrally connected with each other by a lower carriage 19, and a X-axis guide-bar 21 is provided in such a manner as to extend along the X axis at right angles to the Y axis. An upper carriage 23 is slidably mounted on the X-axis guide-bar 21 so as to move in the X axis, and the upper carriage 23 is provided with a plurality of workpiece clamps 25 for holding the workpiece so that it may be moved in the X axis and fixed thereon. The movable tables 15 and the upper carriage 23 are so arranged as to be moved in the Y and X axes, respectively, by a Y-axis drive means and a X-axis drive means, respectively, which are not shown but are numerically controlled. Thus, the workpiece held by the workpiece clamps 25 can be automatically moved in both the Y and X axes under numerical control.

Beneath the upper frame 9, an upper turret 27 of a disk shape for holding a plurality of upper tools is so provided as to be rotated about a shaft 29 which is fixed at the upper frame 9. Also, a lower turret 31 of a disk shape for holding a plurality of lower tools is rotatably provided on the top of the lower frame 5 in such a manner that it may be rotated around the same vertical axis as the upper turret 27. The upper and lower turrets 27 and 31 are vertically separated from each other so that the workpiece automatically fed can be moved therebetween. Also, the upper and lower turrets 27 and 31 are synchronously rotated by drive means comprising a motor 33 and a chain 35, and they are positioned and fixed when positioning pins (not shown) are inserted into any of a plurality of positioning holes 37 which are formed at the outer peripheries thereof.

A ram 39 is vertically movably provided at the mid portion of the upper frame 9 so as to strike the upper tools held on the upper turret 27. The ram 39 is vertically driven by a drive means (not shown) which is provided in the upper frame 9 and may be numerically controlled.

Figure 2:
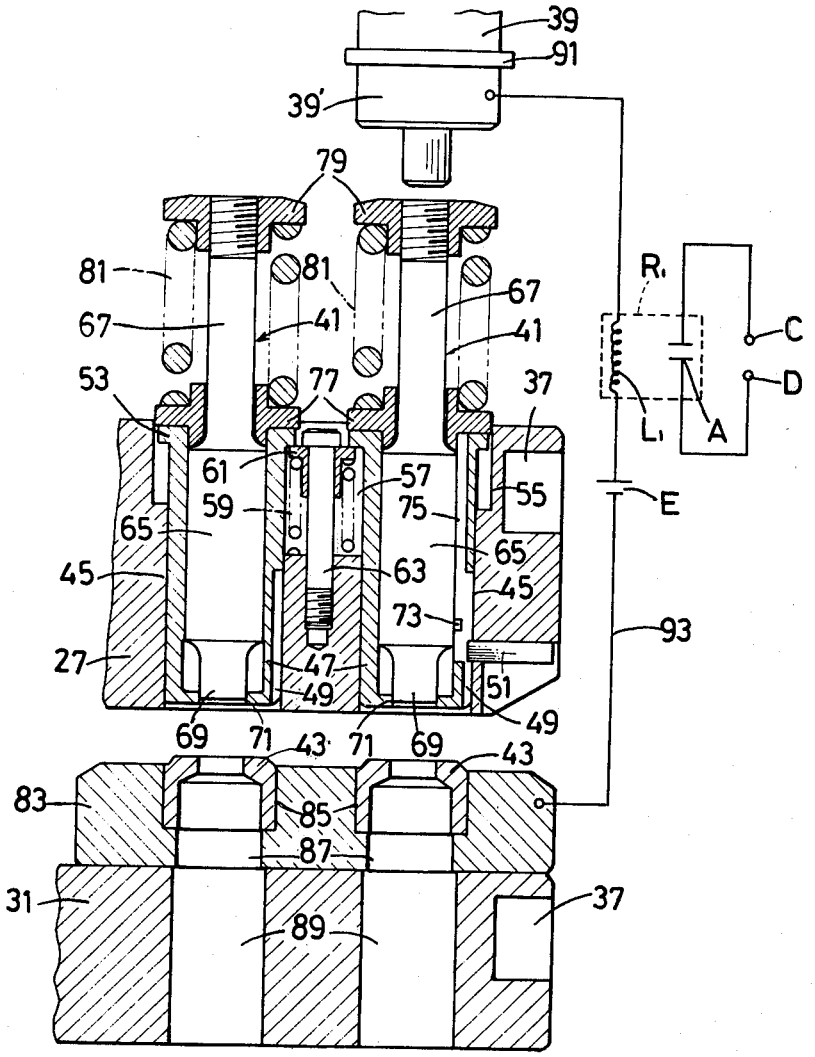
FIG. 2 is an enlarged partial view showing a portion of the turret punch press shown in FIG. 1.

As shown in FIG. 2, the upper and lower tools 41 and 43 are detachably held on the upper and lower turrets 27 and 31, respectively. As is well known, a number of pairs of the upper and lower tools 41 and 43 which are different in shape and size are mounted on the upper and lower turrets 27 and 31 to be selectively used, although the upper and lower turrets 27 and 31 are only partially shown in FIG. 2.

In order to hold the upper tools 41, the upper turret 27 is formed with a plurality of tool-holding holes 45 which are vertically formed through the upper turret 27 and are spaced from each other. In each of the tool-holding holes 45, there is vertically slidably inserted a tubal guide member 47 which acts to press the workpiece to be punched by the upper tool 41. The tubal member 47 is formed at its periphery with a vertical guide groove 49 in which a guide member 51 provided at the upper turret 27 is engaged, and thus the tubal member 47 is prevented from rotating in the tool-holding hole 45. The tubal member 47 is integrally provided at its top portion with a flange 53 which is vertically movable in an enlarged portion 55 provided at the upper portion of the tool-holding hole 45.

A plurality of vertical holes 57 are formed in connection with the enlarged portions 55 of the tool-holding holes 45, and a lift spring 59 is inserted in each of the vertical holes 57 so as to upwardly bias the tubal member 47. Particularly, a flanged tubal member 61 is vertically slidably inserted in each of the vertical holes 57 in such a manner as to ride on the top of the lift spring 59, and a bolt 63 is vertically fixed in each of the vertical holes 57 in such a manner as to pass through the flanged tubal member 61 and prevent the same from being jumped out of the vertical hole 57. Thus, all the tubal members 47 are upwardly biased by the lift springs 59 through the flanged tubal members 61 urging upwardly the flanges 53 of the tubal members 47.

Each upper tool 41, which has a cylindrical body portion 65, a shank 67 at its top and a cutting edge 69, is vertically slidably inserted in the tubal member 47 so that its cutting edge 69 may be downwardly projected through a guide hole 71 formed at the lower end of the tubal member 47. Each of the upper tools 65 may be provided at its body portion 41 with a projecting guide key 73 which is engaged with a guide way 75 vertically formed at the inner wall of the tubal member 47, and thus the upper tool 41 is prevented from rotating in the tubal member 47. In each of the upper tools 41, a ring member 77 is slidably provided around the shank 67 in such a manner as to ride on the top of the tubal member 47, and a flange member 79 is fixed at the top of the shank 67. Also, in each of the upper tools 41, a stripping spring 81 (having a stronger force than the lift spring 59) is provided around the shank 67 between the ring member 77 and the flange member 79 so that it will strip the upper tool 41 out of the workpiece after each completion of a punching operation.

As shown in FIG. 2, an annular plate 83 is fixed on the top of the lower turret 31, and it is formed with a plurality of tool-holding holes 85 in which the lower tools 43 cooperate with the upper tools 41. Each of the tool-holding holes 85 is formed at its bottom with a discharging hole 87 from which slugs punched from the workpiece are discharged. Also, the lower turret 31 is formed with a plurality of discharging holes 89 each of which are connected with the discharging hole 87 of the annular plate 83 so that slugs made from the workpiece are discharged therethrough.

In punching operations, the workpiece is first placed on the fixed table 11 and the movable tables 15. The workpiece then is clamped by the workpiece clamps 25 at a predetermined position. The workpiece will be automatically moved in the Y and X axes by a predetermined program under the numerical by the Y-axis and X-axis drive means under the numerical control. Next, the upper and lower turrets 27 and 31 are synchronously rotated to bring a desired pair of upper and lower tools 41 and 43 just beneath the ram 39 and are positioned at such a desired position. Then, when the ram 39 is lowered to strike the upper tool 41, the workpiece placed on the lower tool 43 will be punched by the upper and lower tools 41 and 43. Particularly, when the ram 39 is lowered to press the upper tool 41, the tubal member 47 will be first lowered against the lift spring 59 (weaker than the stripping spring 81) in order to hold the workpiece onto the lower tool 43, and then the upper tool 41, having been lowered together with the stripping spring 81, will be further lowered against the stripping spring 81 to punch the workpiece with the lower tool 43. When the ram 39 is raised up after completion of a punching cycle, the punch 41 is first upwardly stripped out of the workpiece by the stripping spring 81 and then is returned up to the original position by the lift spring 59 by means of the tubal member 47. The same cycles as described above are repeated on subsequent punching operations, although the upper and lower turrets 27 and 31 will be rotated to use various pairs of the upper and lower tools 41 and 43.

According to the present invention, the lowermost end 39' of the ram 39 is electrically insulated by an insulating material 91 from the upper portion of the ram 39 in the above described turret punch press 1 as shown in FIG. 2. Also, the lowermost end 39' of the ram 39 is connected with the lower turret 31 through an electric circuit 93 which is connected with a direct current source E. A coil $L_1$ of a relay $R_1$ is provided in series in the electric circuit 93, and terminals C and D of a normally open contact A of the coil $L_1$ are connected in series with a main circuit (not shown) for driving the turret punch press 1. Thus, when the lowermost end 39' of the ram 39 is in contact with the top of the upper tool 41 to normally make a punching cycle, the electric circuit 93 will be closed through the lowermost end 39' of the ram 39, the upper tool 41 and the upper and lower turrets 27 and 31, and the coil $L_1$ of the relay $R_1$ will be energized to connect the normally open contact A without opening the main circuit for the turret punch press 1 so that the punching cycles may be repeated. However, once the upper tool 41 is mis-stripped namely the lowermost end 39' of the ram 31 is brought out of contact with the top of the upper tool 41 when returning to its upper limit, the coil $L_1$ of the relay $R_1$ will be de-energized to cut the normally open contact A and the main circuit for the turret punch press 1 will be opened so as to completely stop the turret punch press 1.

In the above described embodiment, the terminals C and D of the normally open contact A are connected in series with the main circuit for driving the turret punch press 1. However, as will be readily understood by those skilled in the art, the opening and closing of the normally open contact A of the relay $R_1$ can be taken as signals ON and OFF, respectively, and thus an arrangement can be made so as to completely stop the turret punch press 1 or otherwise stop only the drive means for feeding the workpiece through the numerically controlling means when the signal OFF is made.

Figure 3:
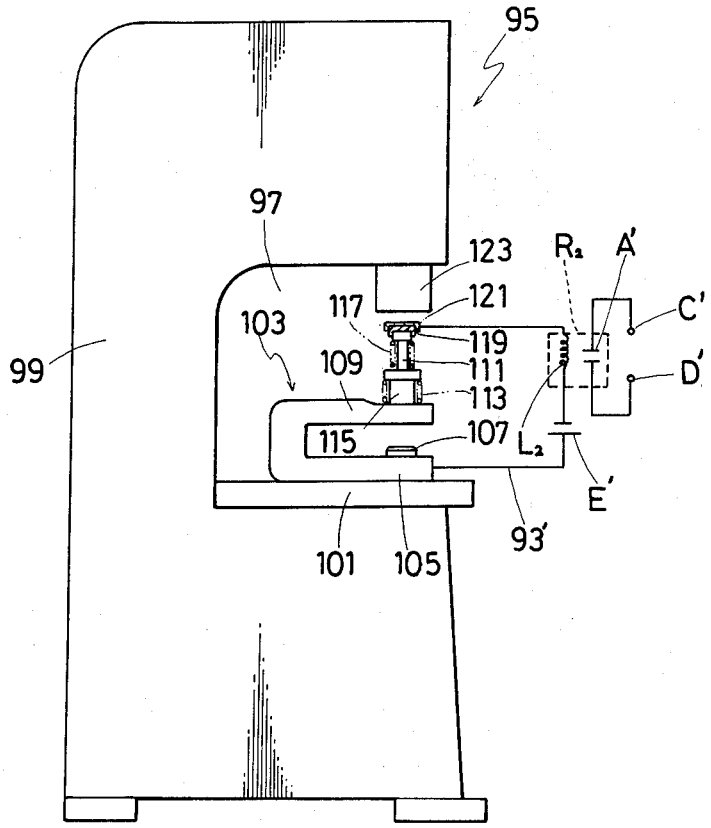
FIG. 3 is a side elevational view of a press embodying the principles of the present invention.

Referring to FIG. 3, the present invention will be described as embodied with regard to a typical press 95 which is constructed of a C-shaped frame 99 having a throat 97 where a bolster 101 is provided. There is detachably mounted on the bolster 101 a C-shaped tool holder 103 having upper and lower arms 109 and 105 in which upper and lower tools 111 and 107, respectively, are detachably mounted to cooperate with each other to punch a workpiece to be placed therebetween. The upper tool 111 is vertically slidably inserted in a flanged tubal member 115 which is also vertically slidably inserted in a bore formed through the upper arm 109 and is upwardly biased by a lift spring 113. In order to strip the upper tool 111 from the workpiece, a stripping spring 117 is provided to upwardly bias the upper tool 111 in such a manner as to surround the same and ride on the tubal member 115.

According to the present invention, the upper tool 111 is provided at its top with a conductive member 121 which is electrically insulated by an insulating material 119. However, the upper tool 111 is conventional in that it is downwardly struck by a ram 123 which is vertically movably provided at the upper portion of the press 95 and is driven by a conventional drive means (not shown). The conductive member 121 fixed at the top of the upper tool 111 is connected with the tool holder 103 through an electric circuit 93' which is connected with a direct current source E' in the same manner as the electric circuit 93 described hereinbefore. A coil $L_2$ of a relay $R_2$ is connected in series to the electric circuit 93', and also terminals C' and D'0 of an open contact A' of the coil $L_2$ are connected in series with a main circuit (not shown) for driving the press 1. Thus, once the upper tool 111, pressed down by the ram 123, is mis-stripped from the workpiece and the ram 123 goes out of contact with the conductive member 121 when returning to its upper limit, the electric circuit 93', which has been closed by means of the conductive member 121, the ram 123 and the frame 99, will be opened to completely stop the press 95.

In the above, the descriptions have been made providing that the lower end of the ram (39, 123) and the top of the upper tool (41, 111) are kept in contact with each other even when the ram (39, 123) is at its uppermost stroking limit in presses in which the lowermost stroking limit of the ram (39, 123) is adjustable. In most cases, however, the lower end of the ram (39, 123) is out of contact with the top of the upper tool (41, 111) when the ram (39, 123) is at its uppermost stroking limit as shown in FIGS. 2 and 3. Accordingly, the electric circuit (93, 93') will be opened and the normally open contact (A, A') will be cut to stop the press (1, 95) without mis-stripping of the upper tool (41, 111) in the above described manner. In order to solve this problem, descriptions will be made in the following with regard to the turret punch press 1 shown in FIG. 1.

Figure 4:
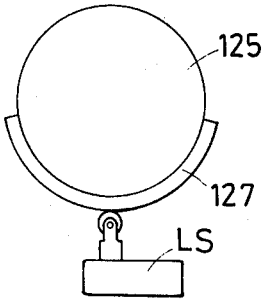
FIG. 4 is an enlarged partial view showing a portion (a crank shaft) included in the presses shown in FIGS. 1 and 3.
Figure 5:
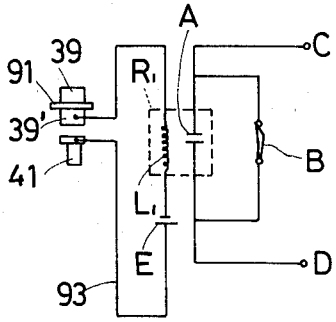
FIG. 5 is an electric circuit applicable to the turret punch press shown in FIG. 1.

Referring to FIG. 4, there is shown in cross section a crank shaft 125 for driving the ram 39 in the turret punch press 1. In this connection, although descriptions will be made with regard to the turret punch press 1 for convenience, it is to be understood that descriptions are applicable to the press 95 shown in FIG. 3 and therefore the crank shaft 125 may be that of the press 95. The crank shaft 125 is fixed at its periphery with a dog member 127, and a limit switch LS is provided in the proximity of the crank shaft 125 so that it may be actuated by the dog member 127. The limit switch LS has a normally closed contact B as shown in FIG. 5 which is so disposed as to be opened when actuated by the dog member 127. The dog member 127 is so arranged as to actuate the limit switch LS when the crank shaft 125 is within 80° before and after its bottom dead center within a 160° range surrounding its bottom dead center, that is, where the ram 39 is at its lowermost limit.

Stated otherwise, the limit switch LS is so disposed as to be kept actuated or opened from just before the upper tool 41 is brought into contact with the workpiece by the ram 39 until just after it is going up out of contact with the same after having made a punching operation. As shown in FIG. 5, the normally closed contact B of the limit switch LS is connected with the electric circuit 93 in parallel with the normally open contact A of the relay $R_1$ to make up an OR circuit, and the terminals C and D are connected with the main circuit for driving the turret punch press 1.

The principles of the present invention will be further described with reference to FIGS. 6 and 7 which are sequence diagrams illustrating the sequences of the cycle S of the ram 39, the closings ON and the openings OFF of the normally open contact A of the relay $R_1$, the normally closed contact B of the limit switch LS, and the terminals C and D of the OR circuit. Also, FIG. 6 illustrates the sequences in a case when the punching operations are being normally made, while FIG. 7 shows the sequences in a case when a mis-stripping of the upper tool 41 occurs when the ram 39 is in the proximity of its bottom dead center.

Figure 6:
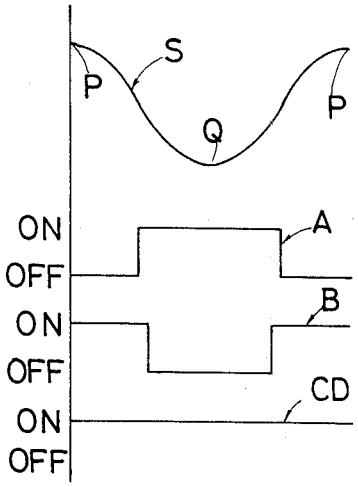
FIGS. 6 and 7 are sequence diagrams for illustrating the principles of the present invention.
Figure 7:
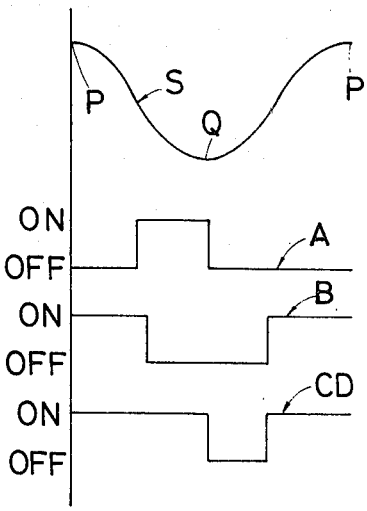

When the punching operations are being normally made, the ram 39 will repeatedly make a cycle of crank angles 360° in which it moves from its top dead center P to its bottom dead center Q and then returns to its top dead center P as the crank shaft 125 rotates as shown in FIG. 6. The normally closed contact B will be kept closed ON between crank angles 0° (top dead center) and 100° where it is not actuated by the dog member 127, and it will be kept open OFF between crank angles 100° and 260° and closed ON between crank angles 260° and 360° (top dead center). The normally open contact A of the relay $R_1$ will be kept open OFF between crank angles 0° (top dead center) and 90° where the ram 39 goes down into contact with the top of the upper tool 41, and it will be kept closed ON between crank angles 90° and 270° and open OFF between crank angles 270° and 360° (top dead center). Thus, when the normally closed contact B of the limit switch LS is kept open OFF, the normally open contact A of the relay $R_1$ will be kept closed ON, and also when the normally open contact A of the relay $R_1$ is kept open OFF, the normally closed contact B of the limit switch LS will be kept closed ON. Accordingly, the terminals C and D of the OR circuit will be always kept closed ON so that the punching operations may be normally continued.

When the upper tool 41 is mis-stripped from the workpiece and does follow the ram 39 when the ram 39 is in the proximity of its bottom dead center (crank angle 180°), for instance, the normally closed contact B of the limit switch LS will be kept open OFF between crank angles 100° and 260° and the normally open contact A of the relay $R_1$ will be opened OFF; therefore, the terminals C and D of the OR circuit will be opened OFF. Thus, once the terminals C and D of the OR circuit are opened OFF, the main circuit for driving the turret punch press 1 will be opened OFF to stop the turret punch press 1.

Although a preferred form of the present invention has been illustrated and described, it should be understood that the device is capable of modification by one skilled in the art without departing from the principles of the invention. Accordingly, the scope of the invention is to be limited only by the claims appended hereto.

We claim:

1. An apparatus for detecting mis-strippings in a press having a ram and upper and lower tools for punching workpieces, comprising:

an electric circuit which is closed when the ram and the upper tool are in contact with each other, a relay provided in the electric circuit, said relay being actuated when the ram and the upper tool are brought out of contact with each other when said ram is returning from a bottom dead center position to a top dead center position, and a contact in the relay, said contact being connected with a main circuit means for driving the press.

2. The apparatus as claimed in claim 1, further comprising:

a limit switch provided in parallel with the contact of the relay, said limit switch being so arranged as to be actuated when the ram is in the proximity of its bottom dead center position.

3. The apparatus as claimed in claims 1 or 2, wherein: said ram is provided at a lowermost end with a conductive member which is insulated by an insulating material from an upper portion of the same ram.

4. The apparatus as claimed in claims 1 or 2, wherein: said upper tool is provided at its top with a conductive member which is insulated by an insulating material from a lowermost end of the ram.

* * * * *